US005172177A

United States Patent [19]

O'Dea et al.

[11] Patent Number: 5,172,177

[45] Date of Patent: Dec. 15, 1992

[54] IMAGE-FORMING APPARATUS HAVING AN OPENABLE SHEET GUIDE

[75] Inventors: Dennis J. O'Dea, Macedon; Kenneth R. Kanis, Rochester; Steven M. Russel, Pittsford; William T. Matthias, Rochester, all of N.Y.

[73] Assignee: Eastman Kodak Company, Rochester, N.Y.

[21] Appl. No.: 871,162

[22] Filed: Apr. 20, 1992

[51] Int. Cl.[5] ..... G03G 15/20

[52] U.S. Cl. ..... 355/285; 355/290; 355/309; 219/216

[58] Field of Search ..... 355/285, 289, 290, 309, 355/282; 219/216, 388

[56] References Cited

U.S. PATENT DOCUMENTS

| | | | |
|---|---|---|---|
| 4,598,990 | 7/1986 | Kusumoto . | |
| 5,023,667 | 6/1991 | Negoro et al. | 355/294 |
| 5,045,887 | 9/1991 | Nakamura | 355/290 X |
| 5,087,947 | 2/1992 | Torino | 355/290 |
| 5,099,289 | 3/1992 | Kurotori et al. | 355/290 |

FOREIGN PATENT DOCUMENTS

| | | | |
|---|---|---|---|
| 2-160273 | 6/1990 | Japan | 355/290 |
| 2-273773 | 10/1990 | Japan | 355/290 |

*Primary Examiner*—Richard L. Moses
*Attorney, Agent, or Firm*—Leonard W. Treash, Jr.

[57] ABSTRACT

Receiving sheet jams in a toner image fuser are cleared by raising an upper frame of an image-forming apparatus. A pressure roller in the fuser is fixed to the upper frame and separates from a fusing roller when the upper frame is raised. Inner and outer guides providing a slot for the receiving sheet leading away from the fuser to an output hopper are mounted to separate when the upper frame is raised, permitting clearance of paper stuck between the guides. The outer guide is prevented from following the inner guide as the upper frame is raised, but instead stops at a position covering the fusing roller to prevent touching of a hot fusing roller by the operator while the operator is clearing a jam.

11 Claims, 7 Drawing Sheets

IMAGE-FORMING APPARATUS HAVING AN OPENABLE SHEET GUIDE

This invention relates to an image-forming apparatus having a fuser for fusing toner images to a receiving sheet and a guide means downstream from the fuser to guide the receiving sheet away from the fuser. More particularly, this invention deals with the clearing of jams in such apparatus.

In image-forming apparatus in which a toner image is transferred to a receiving sheet and then fused to the receiving sheet, it is common practice to design the path of the receiving sheet generally along the top of the apparatus. If a jam appears along the top, the upper portion of the apparatus can be raised, opening up the path for clearing.

The fuser in such apparatus commonly fixes the toner image by passing it through a heated pressure nip formed by a pressure roller and a heated fusing roller. It is known to position the heated fusing roller in the lower portion of the apparatus and the pressure roller in the upper portion. This permits separation of the rollers automatically when the upper portion is raised, clearing any paper stuck in the fuser itself.

Paper guides are generally positioned between the fuser and an output tray of the apparatus to guide the sheet as it is driven by the fusing rollers. Depending on the distance of the path to an output tray, a pair of sheet-feeding rollers may be positioned between the fuser and the exit. If the sheet path is generally a straight one out of the side of the apparatus, it is common to separate the paper guides downstream of the fuser when the upper portion of the apparatus is raised. If the exit is directly above the fuser, the guides are generally not separated and are totally contained in the upper portion of the apparatus. Clearance of paper caught in these guides must be done either from the final exit of the apparatus or from the fuser.

It is important that the operator, when clearing paper from the fuser, not touch the fusing roller which can be quite hot. Typically, warnings are posted in the area of the fuser to prevent such touching.

SUMMARY OF THE INVENTION

It is an object of the invention to provide an image-forming apparatus which includes means for guiding the receiving sheet from a fuser to the apparatus exit which is readily made accessible for clearing of jams without one or more of the problems associated with the prior art.

This and other objects is accomplished in an apparatus which has inner and outer guide means coupled to an upper frame of the apparatus which guide means define a slot for directing a receiving sheet as it leaves the fuser. The upper frame of the apparatus is movable to a position separating a pressure roller and fusing roller in the fuser. As part of that movement, the inner and outer guide means are also separated providing access to any paper stuck in the guide slot.

According to a preferred embodiment, the receiving sheet exit for the apparatus is located generally above the fuser. The inner and outer guide means are curved from the fuser to the exit. The inner guide means moves with the upper frame as it is raised to clear a jam. The outer guide means moves to a position in which it protects the operator from touching a heated fusing roll but stops in that position, allowing the inner guide means to move away from it to open the slot for jam clearance. In this preferred form, the invention provides both an opening of the guide means for clearance and protection for the operator from touching the fusing roller.

DESCRIPTION OF THE PREFERRED EMBODIMENTS

Figure 1:
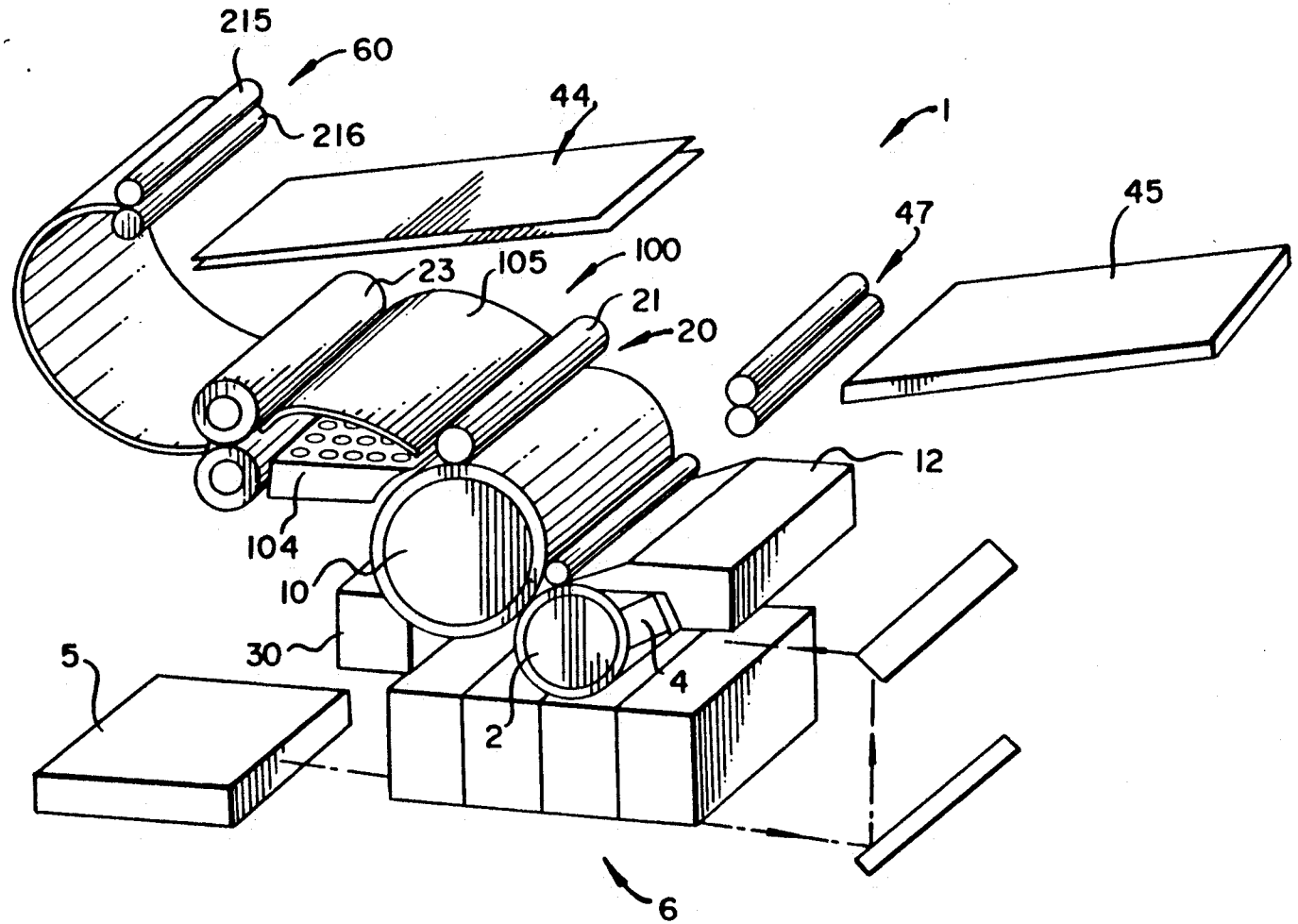
FIG. 1 is a perspective schematic of an image-forming apparatus in which the invention is usable.

According to FIG. 1, and image-forming apparatus 1 includes a primary image member, for example, a photoconductive drum 2, which is rotatable past a series of stations to form a series of toner images on its periphery. More specifically, the periphery of drum 2 is uniformly charged by a charging device 4. An exposing device, for example, a laser 5, exposes the charged periphery to create a series of electrostatic images thereon. The electrostatic images are toned by a development device 6. Development device 6 includes four separate toning stations which are indexed into operative relation with drum 2 to apply a different color toner to each of four consecutive images to create a series of different color toner images.

The series of different color toner images are transferred in registration to an image surface on an intermediate image member, for example an intermediate drum 10. The four single-color images, when transferred in registration, form a multicolor image on the image surface of intermediate drum 10. The multicolor image is transferred to a receiving sheet at a transfer station 20. The receiving sheet is fed from a receiving sheet supply 45 through a pair of conventional timing rollers 47 into a nip formed by intermediate drum 10 and an articulatable transfer backing roller 21 at transfer station 20. Transfer backing roller 21 is biased to attract the toner in the multicolor image to the receiving sheet. As the receiving sheet exits the nip between transfer roller 21 and intermediate drum 10, it is driven by drum 10 toward a fixing station or device, for example a roller fuser 23. Transport of the receiving sheet from the intermediate image member 10 to fuser 23 is controlled by an air transport device 100 which will be more thoroughly explained with respect to FIGS. 2–7.

After the receiving sheet exits fuser 23, it is guided to a pair of sheet-feeding rollers 60 and, hence, to an output tray 44 positioned generally above the fuser 23 and the transport device 100. The mechanism for guiding the receiving sheet between the fuser 23 and the sheet-feeding rollers 60 will be described more thoroughly with respect to FIGS. 8–10.

The photoconductive drum 2 is continuously cleaned by a blade cleaner 12 while intermediate drum 10 is intermittently cleaned by a suitable cleaning mechanism 30 which is articulated in and out of cleaning relation with drum 10. Photoconductive drum 2, charging device 4 and photoconductive drum cleaner 12 can all be supplied in a cartridge convenient for replacement of the components included in it.

Figure 2:
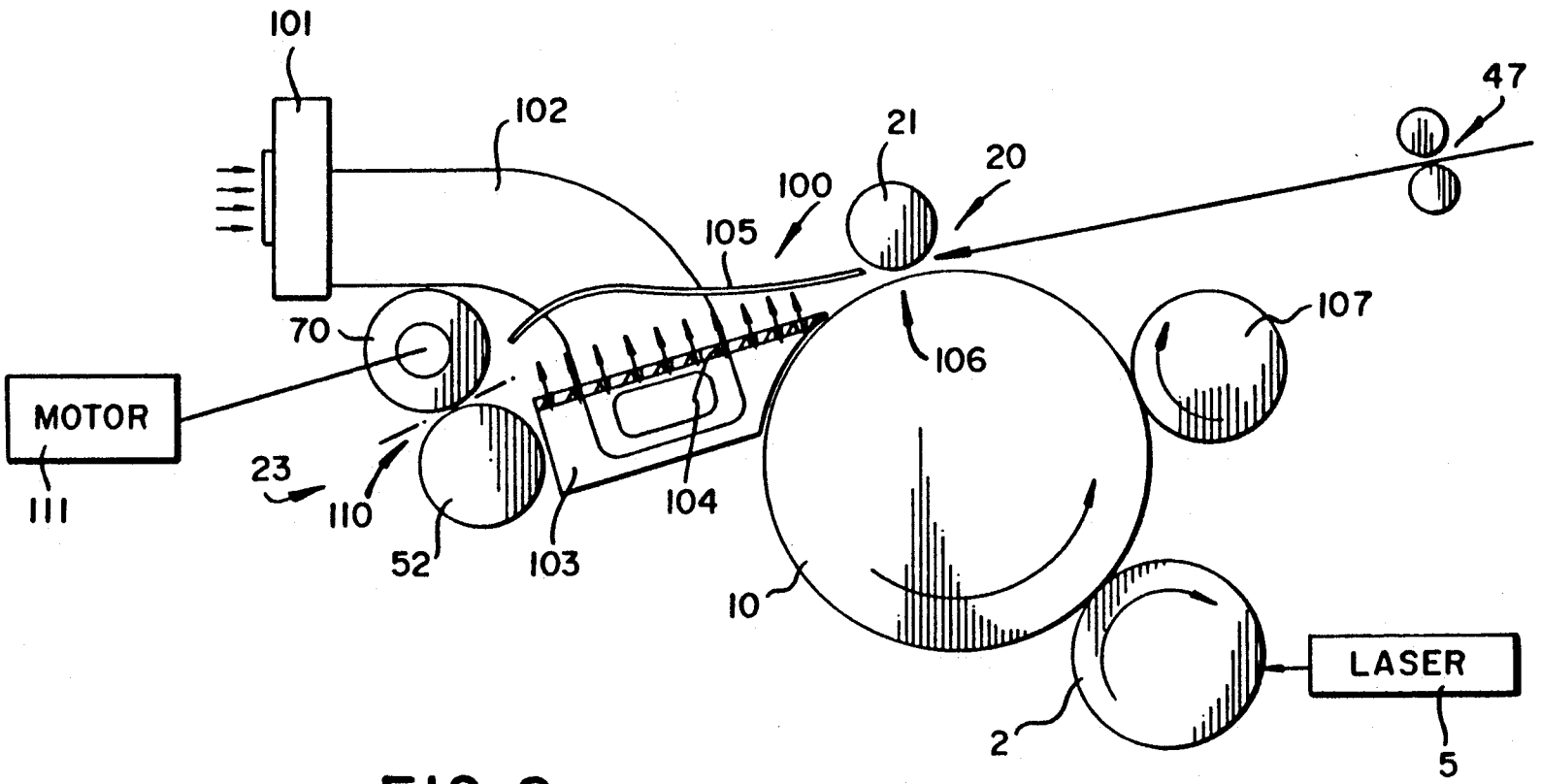
FIG. 2 is a front schematic illustrating the components associated with receiving sheet transport between an image member and fixing device in the image-forming apparatus shown in FIG. 1.

Referring to FIG. 2, a receiving sheet fed from timing rollers 47 enters a transfer nip 106 formed by transfer backing roller 21 and intermediate drum 10. Transfer roller 21 is out of contact with drum 10 while the images are being transferred to drum 10. It is moved into position, forming nip 106 as the full multicolor image approaches transfer station 20. The toner image is transferred from drum 10 to the bottom or first side of the receiving sheet in the nip 106, and the receiving sheet leaves the nip with the toner image loosely adhering to it. For various reasons, primarily having to do with the beam strength of the sheet, and the relative size and hardness of roller 21 and drum 10, the receiving sheet does not stick to drum 10.

A blower 101 feeds air through a duct 102 to a plenum chamber 103 directly below the proposed path for the receiving sheet. Air from the blower is forced out through an orifice plate 104 positioned on the bottom or first side of the receiving sheet, which is the side carrying the image in this embodiment. Air from the orifice plate against the first side of the sheet forces the receiving sheet upward toward a paper guide 105 positioned on the top, second or nonimage-bearing side of the receiving sheet. Paper guide 105 is curved to guide the paper through a curvilinear path from intermediate image member 10 and nip 106 to fuser 23. Fuser 23 is a pressure roller fuser including a fusing roller 52 and a pressure roller 70 which rollers form a nip 110 that is tilted somewhat to accept the receiving sheet coming from the curvilinear path. The fuser is driven by a motor 111 which drives pressure roller 70 at a speed that moves the receiving sheet very slightly faster than it is being driven by intermediate image member 10. Fusing roller 52 is driven by pressure roller 70 through direct frictional contact and through any receiving sheet in nip 110.

Figure 3:
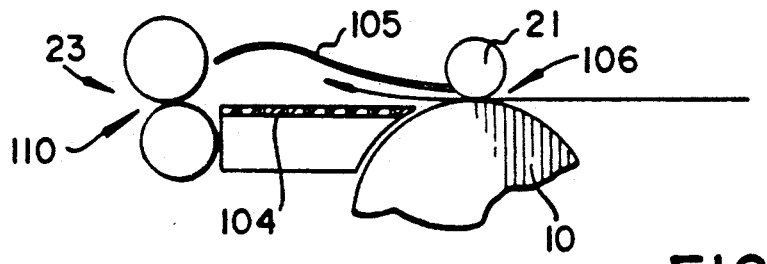
FIGS. 3, 4, 5 and 6 are front schematics similar to FIG. 2 illustrating different positions of movement of the receiving sheet through a transport path.
Figure 4:
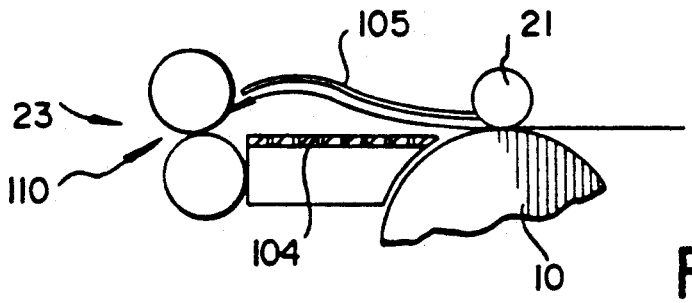
Figure 5:
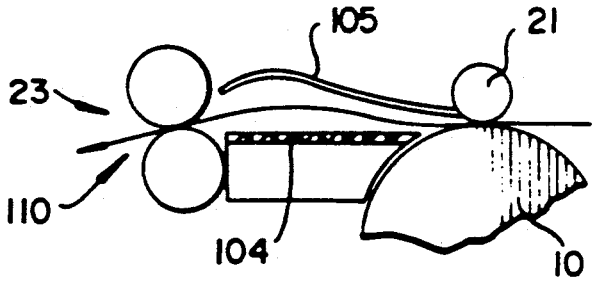
Figure 6:
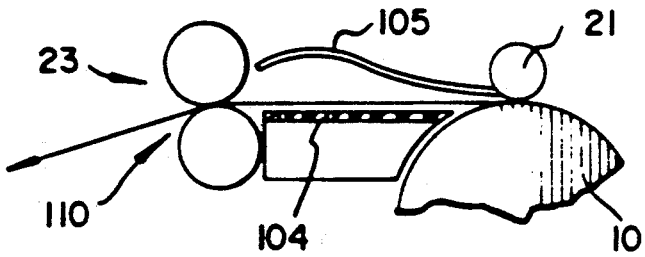

FIGS. 3–6 illustrate the movement of the receiving sheet between intermediate image member 10 and fuser 23. As shown in FIG. 3, as the sheet exits transfer nip 106, it is immediately deflected toward guide 105 by air coming through orifice plate 104. Guide 105 is curved to provide a substantially increased path length compared to the path a sheet would follow if it went straight. Guide 105 is also curved downward at its left end, as seen in FIG. 4, to direct the receiving sheet down into the nip 110 of fuser 23. Because fuser 23 drives the receiving sheet slightly faster than does intermediate image member 10, the receiving sheet gradually begins to straighten against the force of the air coming from orifice plate 104, as shown in FIG. 5. Preferably, the receiving sheet exits the transfer nip 106 before or as it becomes fully straight, as shown in FIG. 6. When it is released by nip 106, it immediately is pushed up against guide 105 by the air from orifice plate 104 and degradation of the image by a speed mismatch between nip 110 and intermediate image member 10 is no longer possible.

Not that the fusing and pressure rollers 52 and 70 are positioned so that a plane bisecting the angle between the guide 105 and orifice plate 105 in the vicinity of the nip 110 is close to a plane bisecting the angle of the two rollers at entrance to the nip. Thus, the rollers are tilted backward to accommodate the curved path of the sheet as it enters the nip, but not too far to cause excessive wrap on the fusing roller 52 when the sheet is straightened out before release by nip 106. This assures a clean entrance to the nip 110 without overheating of the middle of the sheet.

This structure can permit placing of fuser 23 relatively close to intermediate image member 10. For example, 11 and 14 inch receiving sheets can be successfully handled by the apparatus shown in FIGS. 2–6 with only seven inches (in a straight line) separating nip 110 and nip 106. This type of transport can be used from an image member such as intermediate transfer drum 10 as shown in the figures. Alternatively, it can also be used from a photoconductive drum, an intermediate or photoconductive web or similar structures. It can also be used to transport a transfer sheet from a transfer drum to which it had been affixed in receiving several color toner images. It is particularly usable in relatively small image-forming apparatus, because it greatly reduces the transport path and thereby makes the apparatus generally more compact.

Factors contributing to speed variation in both the transfer and fuser nips include nip pressure, paper thickness, relative humidity, aging of the rollers, size tolerance of the rollers due to manufacturing and the actual motor speed tolerance. The sum of all the factors can be as high as 3.5% total speed variation. A difference in path length between the curved paper guide shown and the straight line nip distance is capable of absorbing this entire total speed variation. Thus, if the fuser is set to run nominally at a speed, say, 1.75% faster than the image member and the tolerance factors stack up in the worst case positive direction, then the fuser would be running 3.5% faster than the transfer nip and all the slack in the sheet will be taken up during its travel through the system. Similarly, if the tolerance factors stack up in the worst case negative direction, then the fuser would be running at the same speed as the transfer and none of the slack in the sheet will be taken up. Note that if the fuser is allowed to run slower than the transfer nip, extra slack will be induced and the sheet will buckle. Both buckle of the sheet and stretch of the sheet are undesirable.

Figure 7:
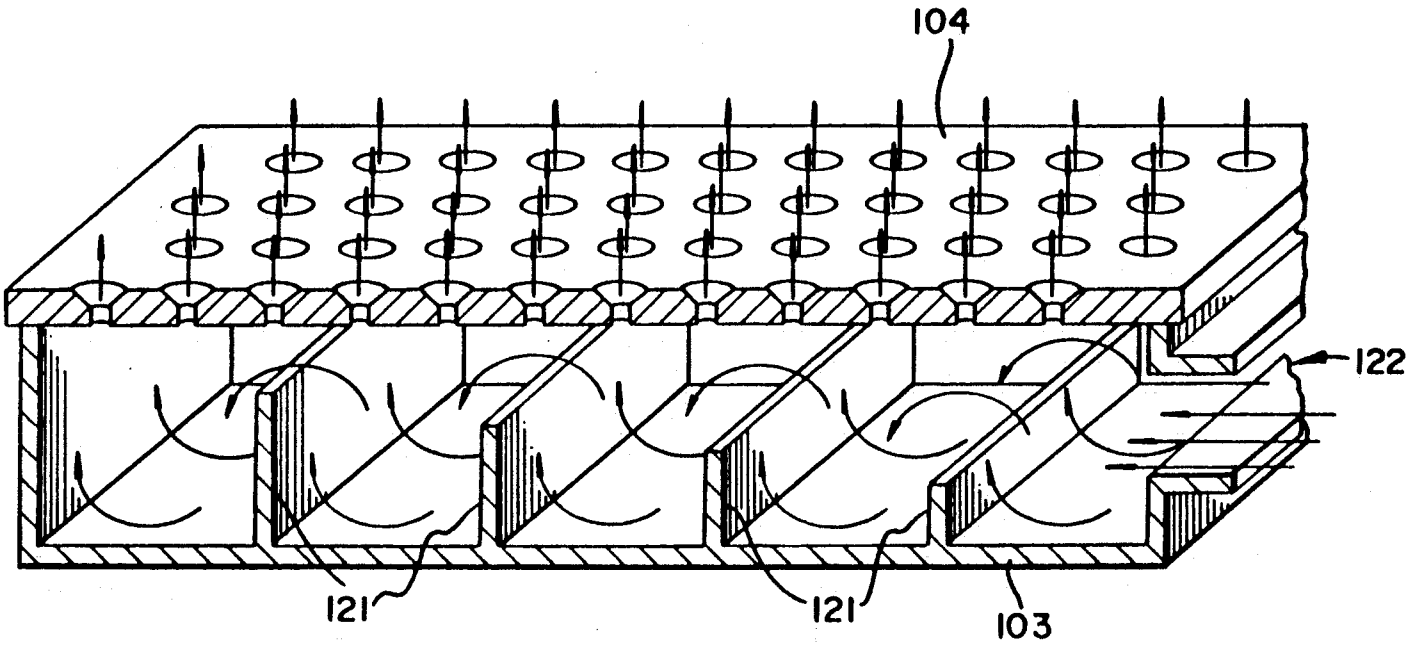
FIG. 7 is a perspective view of the air supply portion of an air transport device usable in the transport shown in FIGS. 2–6.

Referring to FIG. 7, the orifice plate contains holes which, to increase their efficiency, are wider at the air exits than they are at the air entrances. A large number of holes are arranged in staggered rows. Hole size and distribution plus blower performance characteristics and general system impedance characteristics generally determine the character of the air pushings on the image side of the receiving sheet. The actual specifications will vary with the application and can be determined empirically or by using straightforward algorithms. The specifications are set to provide an amount of air that will force the receiving sheet against the guide but will not disturb the image. This system has shown substantial tolerance.

Once the orifice plate is optimized, it is preferred that even pressure distribution be obtained, at least in the crosstrack direction. As shown in FIG. 7, a set of baffles 121 are positioned across the flow of air and increase in height the further away they are from a duct entrance 122. Prior technology used a simple tapered plenum to achieve even pressure, but the tapered baffle approach has turned out to be more effective. This further permits individual baffle plates to be finely tuned by forming raised or lowered portions in them, if necessary, in any given system. Note, this allows varying the pressure distribution in the intrack direction, even though the duct entrance is from the side of the path.

By pushing the sheet up against the paper guide, manufacture of the orifice plate becomes quite inexpensive. It costs a very small fraction of the cost of the original UCAT orifice plate which is required to maintain a sheet between guides. Pushing the sheet upward against a paper guide also ensures an accurate and repeatable entry trajectory into the tilted fuser nip which is important for wrinkle-free fusing.

Figure 8:
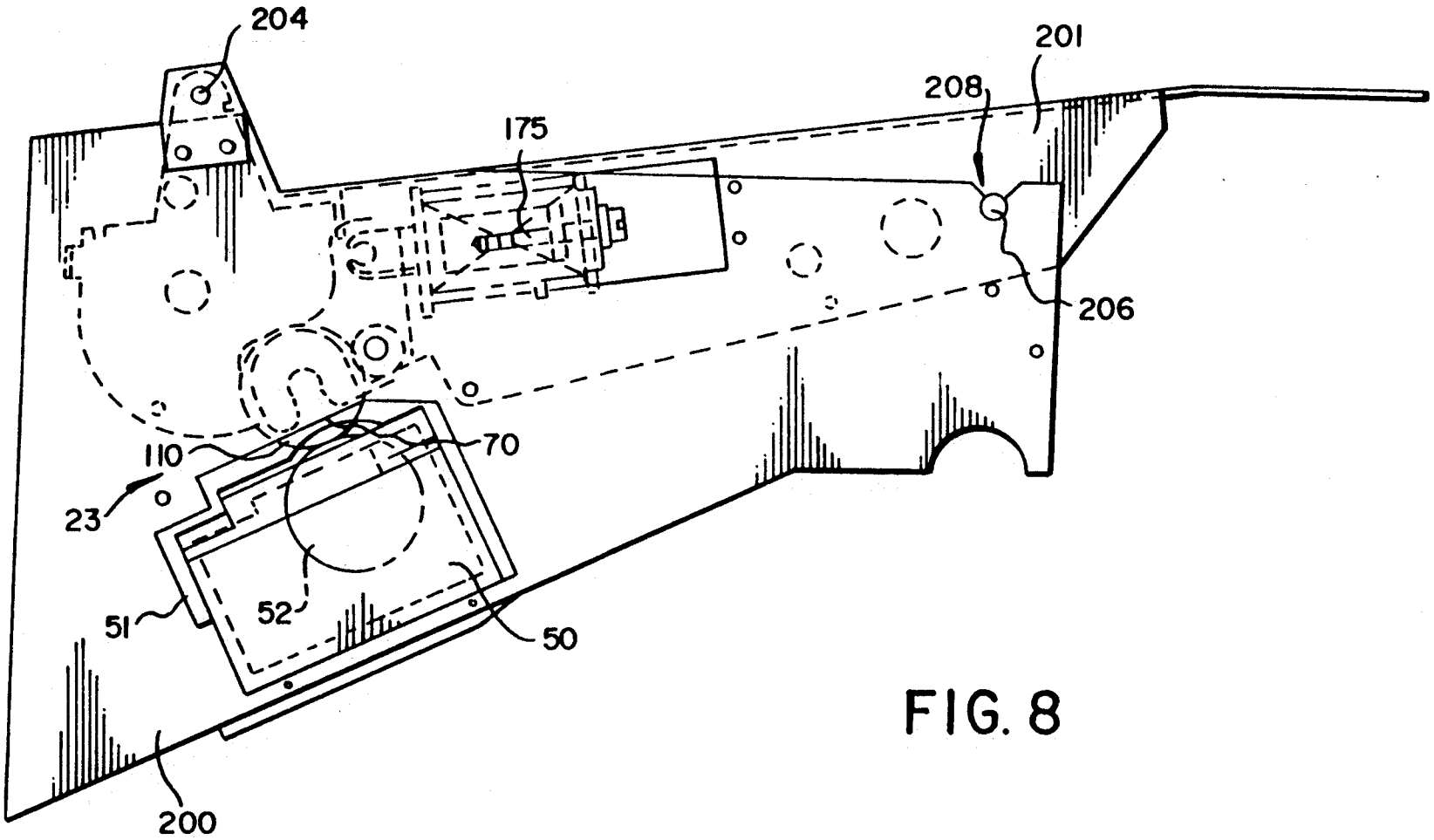
FIG. 8 is a front view generally illustrating the fixing device shown in FIG. 2 and its relation to upper and lower frames of the image-forming apparatus.
Figure 9:
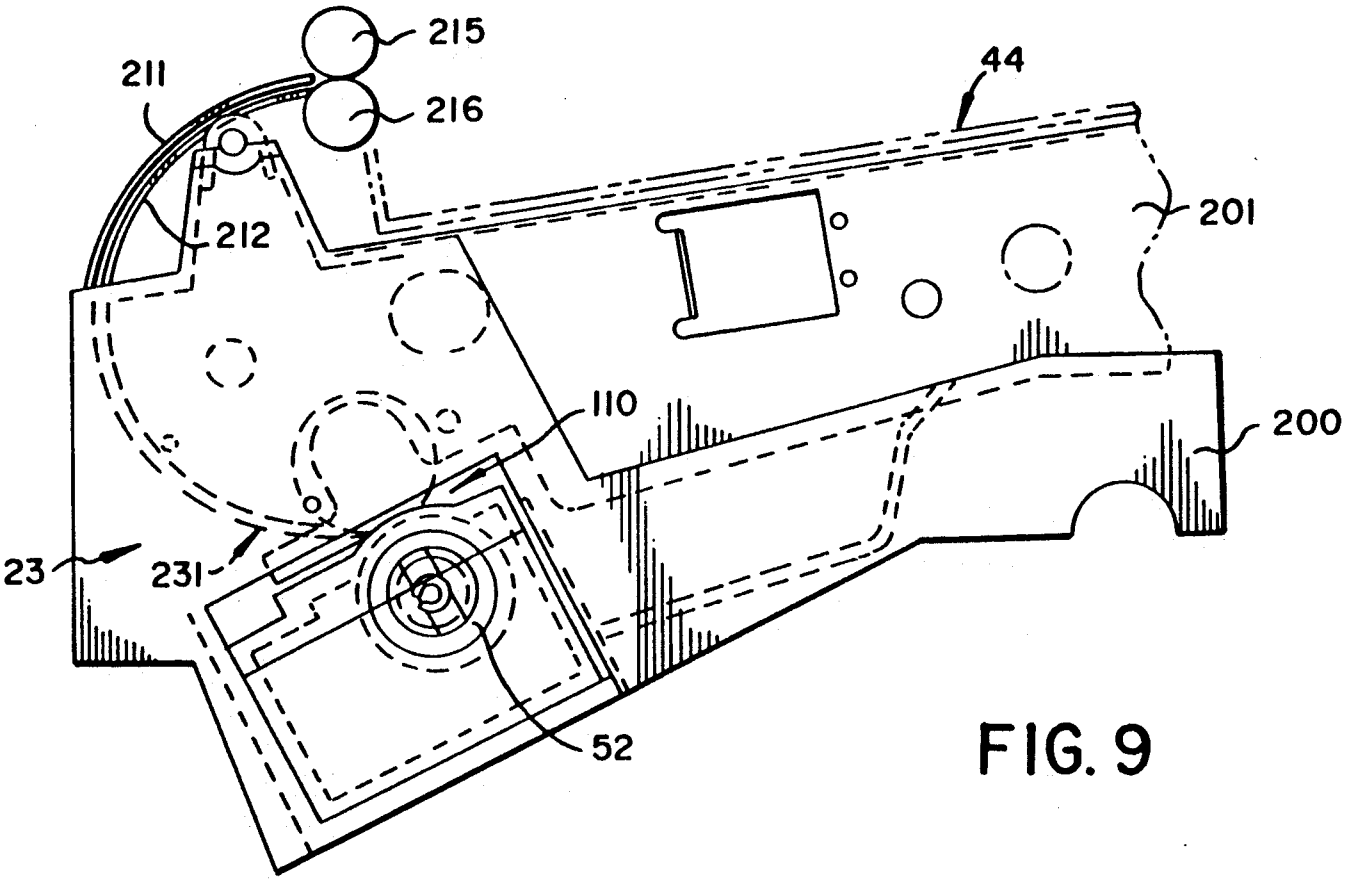
FIGS. 9 and 10 are front views similar to FIG. 8 illustrating different operative positions of an upper frame shown in FIG. 8.
Figure 10:
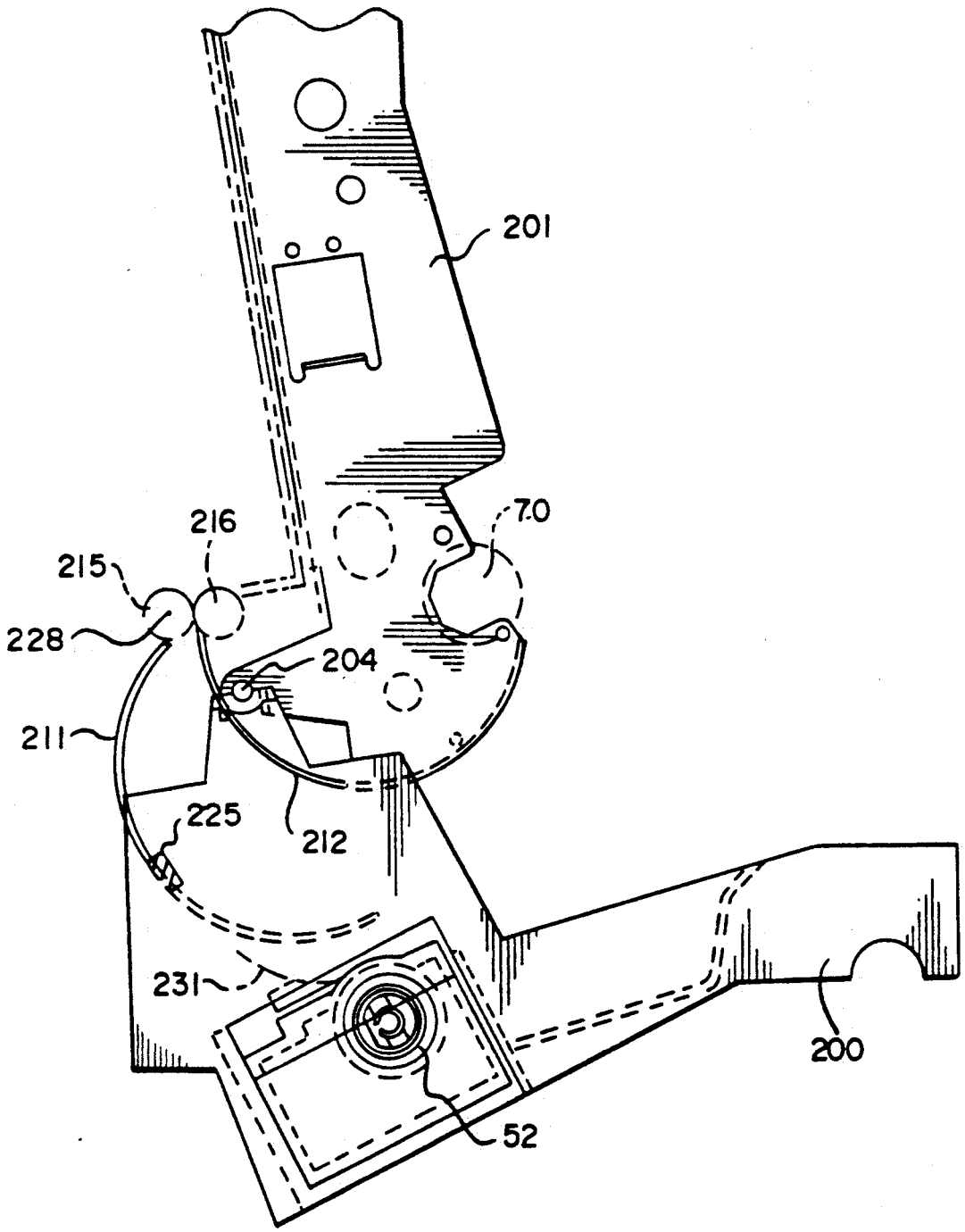

FIGS. 8, 9 and 10 illustrate a mechanism permitting a clearing of the fuser 23 of receiving sheet jams. According to FIG. 8, fuser 23 includes the fusing roller 52 and the pressure roller 70 which are spring urged together to form the pressure fusing nip 110. The fusing roller 52 is supplied in a fusing roller cartridge 50 which is inserted endwise of an opening 51 in a lower frame 200 of image-forming apparatus 1. Lower frame 200 also supports intermediate image member 10, plenum chamber 103 and blower 101 which are not shown in FIG. 8.

Pressure roller 70 is supported by an upper frame 201. Upper frame 201 is coupled to lower frame 200 at a pivot 204. Upper frame 201 is shown in FIG. 8 in its lowered or operative position with a pair if studs 206 fixed to upper frame 201 seated in a pair of slots 208 in lower frame portion 200. Only one stud 206 is shown, but it should be understood that there is another stud and slot set at the rear of the upper and lower frames. In this position, springs 175 provide force on pressure roller 70 providing pressure in nip 110.

As seen in FIG. 9, the receiving sheet which exits fusing nip 110 is guided through approximately a 180° turn by an outer paper guide 211 and an inner paper guide 212 which define a guide slot leading the sheet to first and second paper transport rollers 215 and 216, respectively. The paper transport rollers 215 and 216 are above fuser 23 and are driven to continue transport of the receiving sheet after it leaves the fusing nip 110 and ultimately feed it into an output tray 44.

It is known to swing an upper section of a fuser, including a pressure roller, away from a lower section including a fusing roller to clear receiving sheet jams. However, in rotating an upper section of this type away from the fusing roller, it becomes possible for the operator clearing the jam to touch the fusing roller and be burned. Similarly, paper will sometimes be caught in a pair of guides such as gudes 211 and 212 and be difficult to remove because of their length. This is especially true if the paper has become ripped into smaller pieces in the jamming process.

According to FIG. 10, to clear a jam, an operator rotates upper frame 201 about pivot 204 until pressure roller 70 is substantially separated from fuser roller 52 and the space in the fuser 23 in which a jam is likely is available to the operator for clearing. In this process, inner paper guide 212 fully follows upper frame 201 as it moves. At the same time, rollers 215 and 216, which are journaled in upper frame 201, rotate with frame 201 as it moves.

Outer paper guide 211 is secured around the shaft of roller 215 and is free to pivot about the axis of rotation 228 of roller 215. Outer paper guide 211 has a tendency to follow upper frame 201 due to gravity and, in fact, moves with the inner guide until outer paper guide 211 hits a stop 225 positioned on lower frame 200. Inner paper guide 212 is notched to miss stop 225 as upper frame 201 is opened.

With outer paper guide 211 stopped by stop 225 and upper frame 201 opening inner paper guide 212 away from it, the slot defined by guides 211 and 212 is open sufficiently for the operator to remove any portions of any receiving sheet that are between guides 211 and 212. The limited movement of outer paper guide 212 brings it to a position direclty above fusing roller 52 where it inhibits an operator from touching what may be a very hot fusing roller. Thus, this structure, automatically, both opens the guides leading away from the fusing nip and protects the operator from touching the fusing roller, as part of the swinging of upper frame section 201 to its open position.

A fixed guide 231 mates with outer guide 211 when in the closed position shown in FIG. 9. The fixed guide 231 also helps define the slot into which the transfer sheet goes immediately as it exits the fuser nip 110.

Although not shown in FIGS. 8–10, the curved transport guide 105 and the transfer roller 21 are also located in the upper frame 201 and are moved away from the lower section when that section is opened. Thus, any jam downstream of timing rollers 47 can be cleared by movement of upper section 201 to its open position.

The invention has been described in detail with particular reference to a preferred embodiment thereof, but it will be understood that variations and modifications can be effected within the spirit and scope of the invention as described hereinabove and as defined in the appended claims.

We claim:

1. Image-forming apparatus comprising:

means for forming a toner image on a receiving sheet, a fuser including a pressure roller and a fusing roller positionable to form a pressure nip, means for feeding the receiving sheet into said nip to fix the toner image to the receiving sheet, a lower frame including means for supporting one of said rollers, an upper frame including means for supporting the other of said rollers, pivot means for coupling said upper and lower frames at a pivot about which said upper frame is pivotable between a closed position in which said rollers are engaged forming said pressure nip and an open position in which said rollers are suficiently separated to permit the clearing of a jammed receiving sheet in said nip.

inner and outer guide means defining a guide slot for directing the receiving sheet as it leaves the pressure nip to an exit position generally above the fuser, and means for separating the inner and outer guide means in response to pivoting said upper frame to its second position.

2. Image-forming apparatus according to claim 1 wherein said means for separating includes a stop positioned to prevent movement of said outer guide means as said upper frame is pivoted.

3. Apparatus according to claim 2 wherein said fusing roller is mounted in said lower frame and said stop is fixed to said lower frame and is positioned to allow limited movement of the outer guide to a position inhibiting operator touching of the fusing roller in response to movement of the upper frame to its second position.

4. Apparatus according to claim 1 further including an output hopper for receiving said receiving sheet, said output hopper being located generally above said fuser, first and second sheet feeding rollers positioned to form a nip generally above said fuser and at an edge of said output hopper for transporting sheets from said guide slot to said output hopper.

5. Apparatus according to claim 4 wherein said first sheet feeding roller is mounted on a shaft fixed in said upper frame and said outer guide means is mounted for pivotal movement on said shaft.

6. Apparatus according to claim 5 wherein said means for separating includes a stop positioned to prevent movement of said outer guide as said upper frame is pivoted to its second position.

7. Apparatus according to claim 6 wherein said fusing roller is mounted in said lower frame, said outer guide is mounted to follow said upper frame under the force of gravity as said upper frame moves, and said stop is fixed to said lower frame and is positioned to permit such following movement of said outer guide to a position inhibiting operator touching of the fusing roller as said upper frame is raised.

8. Apparatus according to claim 4 wherein the first and second sheet feeding rollers are fixed to the upper frame.

9. Apparatus according to claim 4 wherein said outer and inner guides curve sufficiently to substantially reverse the direction of movement of the sheet from its direction exiting the pressure nip to its direction exiting the nip formed by the sheet feeding rollers.

10. Apparatus according to claim 6 wherein said outer and inner guides curve sufficiently to substantially reverse the direction of movement of the sheet from its direction exiting the pressure nip to its direction exiting the nip formed by the sheet feeding rollers.

11. Image-forming apparatus comprising:

a fuser including a pressure roller and a fusing roller positionable to form a pressure nip, means for heating the fusing roller, a first frame including means for supporting the fusing roller, a second frame including means for supporting the pressure roller, said frames being separable to separate the rollers to clear jams, and means responsive to separation of said frames for covering the fusing roller to inhibit touching of the fusing roller while clearing jams.

* * * * *